US009887472B2

(12) United States Patent
Park et al.

(10) Patent No.: US 9,887,472 B2
(45) Date of Patent: Feb. 6, 2018

(54) MULTIMEDIA INTERFACE CONNECTOR AND ELECTRONIC DEVICE HAVING THE SAME

(71) Applicant: SAMSUNG ELECTRONICS CO., LTD., Suwon-si (KR)

(72) Inventors: Jin-Yong Park, Suwon-si (KR); Joon Mok Han, Suwon-si (KR); Jae Woong Jung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/220,993

(22) Filed: Jul. 27, 2016

(65) Prior Publication Data

US 2017/0117646 A1 Apr. 27, 2017

(30) Foreign Application Priority Data

Oct. 27, 2015 (KR) ..... 10-2015-0149185

(51) Int. Cl.

| | |
|---|---|
| ***H01R 13/648*** | (2006.01) |
| ***H01R 12/70*** | (2011.01) |
| ***H01R 24/60*** | (2011.01) |
| ***H01R 13/6594*** | (2011.01) |
| ***H01R 12/72*** | (2011.01) |
| *H01R 107/00* | (2006.01) |
| *H01R 13/6587* | (2011.01) |

(52) U.S. Cl.

CPC ..... *H01R 12/7076* (2013.01); *H01R 12/724* (2013.01); *H01R 13/6594* (2013.01); *H01R 24/60* (2013.01); *H01R 13/6587* (2013.01); *H01R 2107/00* (2013.01)

(58) Field of Classification Search

CPC ..... H01R 23/7073; H01R 4/64; H01R 13/65802; H01R 23/688; H01R 23/6873

USPC ... 439/79, 92, 95, 101, 108, 607.07–607.09, 439/607.35–607.37

See application file for complete search history.

(56) References Cited

U.S. PATENT DOCUMENTS

| | | | | | |
|---|---|---|---|---|---|
| 4,628,410 | A * | 12/1986 | Goodman | H05K 3/341 | 361/776 |
| 5,213,524 | A * | 5/1993 | Okamoto | H01R 13/7195 | 439/108 |
| 5,637,014 | A * | 6/1997 | Sukegawa | H01R 23/6873 | 439/607.4 |
| 5,928,035 | A * | 7/1999 | Jankowsky | H01R 12/7052 | 439/607.36 |
| 5,986,342 | A * | 11/1999 | Uchiyama | G02F 1/13452 | 257/676 |
| 7,252,552 | B2 * | 8/2007 | Takimura | H01R 12/725 | 439/620.22 |
| 7,686,646 | B2 * | 3/2010 | Lee | H01R 12/7047 | 439/567 |
| 7,762,840 | B2 * | 7/2010 | Hamner | H01R 13/65802 | 439/541.5 |

(Continued)

*Primary Examiner* — Thanh Tam Le

(74) *Attorney, Agent, or Firm* — Sughrue Mion, PLLC

(57) ABSTRACT

A multimedia interface connector includes a connection terminal in electrical connection with a printed circuit board (PCB); a main ground partially enclosing a first end of the connection terminal; and an auxiliary ground arranged between the main ground and the PCB to form a return path for a signal received through the connection terminal, wherein a second end of the connection terminal and the main ground are connected to the PCB.

12 Claims, 14 Drawing Sheets

(56) References Cited

U.S. PATENT DOCUMENTS

| | | | | |
|---|---|---|---|---|
| 8,070,515 | B2 * | 12/2011 | Nagata | H01R 12/712 439/607.13 |
| 8,109,791 | B2 * | 2/2012 | Kameyama | H01R 23/6873 439/607.37 |
| 8,262,414 | B1 * | 9/2012 | Li | H01R 13/6273 439/607.35 |
| 8,298,016 | B2 * | 10/2012 | Lai | H01R 13/6596 439/607.28 |
| 8,854,835 | B2 * | 10/2014 | Feldstein | H01R 12/724 174/351 |
| 8,882,542 | B2 * | 11/2014 | Song | H01R 23/6873 439/607.4 |
| 8,961,230 | B2 * | 2/2015 | Chou | H01R 9/032 439/607.27 |
| 8,968,031 | B2 * | 3/2015 | Simmel | H01R 13/659 439/108 |
| 9,496,651 | B2 * | 11/2016 | Jeong | H01R 13/665 |
| 9,583,873 | B2 * | 2/2017 | Wang | H01R 13/629 |
| 2012/0071028 | A1 | 3/2012 | Lai et al. | |

* cited by examiner (a)

(b)

(a)

(b)

MULTIMEDIA INTERFACE CONNECTOR AND ELECTRONIC DEVICE HAVING THE SAME

CROSS-REFERENCE TO RELATED APPLICATIONS

This application claims priority to Korean Patent Application No. 10-2015-0149185, filed on Oct. 27, 2015 the disclosure of which is incorporated herein by reference in its entirety.

BACKGROUND

1. Field

Apparatuses and methods consistent with the exemplary embodiments relate to a multimedia interface connector and electronic device having the same.

2. Discussion of Related Art

High Definition Multimedia Interface (HDMI) is one of uncompressed digital video and audio interface standards, providing an interface between multimedia sources, such as set-top boxes, digital versatile disc (DVD) players, etc., and multimedia target devices, such as audio video (AV) devices, monitors, digital televisions, etc.

The HDMI may send images, sounds, or control signals via a single cable. Such an HDMI link includes a plurality of transition minimized differential signaling (TMDS) data channels and a single TMDS clock channel.

The TMDS clock channel works continuously at a speed proportional to the pixel rate of transmitted videos. During every cycle of the TMDS clock channel, three TMDS data channels each send a 10-bit character. The 10-bit character is encoded using one of many encoding technologies.

An HDMI clock signal varies depending on the resolution up to 297 MHz at a resolution of 4K×2K.

Since the HDMI does not employ any Electro Magnetic Interference (EMI) reduction technology for the clock, it may suffer from noise that violates the Electro Magnetic Compatibility (EMC) radiation standard, thereby failing to satisfy the EMI criteria.

For example, resonance characteristics appear at a frequency of 891 MHz resulting from ×3 multiplication of a pixel frequency of 297 MHz, and thus radiated EMI data that exceeds a reference value of 37 dB (uV/m) may be generated.

The reason has been found that the radiation has occurred by the HDMI clock (CLK) among the lines connected to the HDMI connector.

SUMMARY

Exemplary embodiments provide a multimedia interface connector and electronic device having the same, which reduces overall electromagnetic interference (EMI) as well as components radiated from a clock line by additionally arranging an auxiliary ground.

In accordance with an aspect of an exemplary embodiment, there is provided a multimedia interface connector including: a connection terminal combined with a printed circuit board (PCB); a main ground formed to cover one side of the connection terminal while leaving it opened in a first direction; and an auxiliary ground arranged between the main ground and the PCB to form a return path for a signal received through the connection terminal, wherein the other end of the connection terminal and the main ground are combined with the PCB.

The connection terminal may include multiple clock terminals, and the auxiliary ground may be arranged to be adjacent to the clock terminal.

The main ground may be formed to cover the one side of the connection terminal at a distance.

The multimedia interface connector may further include: a terminal holder for fixing the connection terminal at a particular position a predetermined distance away from the main ground.

The terminal holder may be made of an insulating material.

In accordance with another aspect of the present disclosure, a multimedia interface connector includes: multiple groups of connection terminals combined with a printed circuit board (PCB); a plurality of main grounds formed to cover one sides of the respective groups of connection terminals while leaving them opened in a first direction; and a first auxiliary ground arranged to connect the plurality of main grounds, wherein the main grounds are combined with the PCB.

The plurality of main grounds may be located to be separated from one another, and the first auxiliary ground may be formed to connect one sides of the plurality of main grounds located to be separated from one another.

The multimedia interface connector may further include: a plurality of second auxiliary grounds arranged between the respective main grounds and the PCB to form a return path for a signal received through the connection terminals.

The plurality of main grounds may be each formed to cover one side of the connection terminal at a distance.

The multimedia interface connector may further include: a terminal holder for fixing the connection terminal at a particular position a predetermined distance away from the main ground.

A number of terminal holders may be arranged to correspond to the number of the plurality of main grounds.

The terminal holder may be made of an insulating material.

In accordance an aspect of an exemplary embodiment, there is provided an electronic device includes: a semiconductor device; a printed circuit board (PCB) having the semiconductor device mounted thereon; and a multimedia interface connector coupled with a source device for receiving a multimedia execution signal transmitted from the source device, wherein the multimedia interface connector comprises a connection terminal combined with the PCB; a main ground formed to cover one side of the connection terminal while leaving it opened in a first direction; and an auxiliary ground combined with the main ground.

The auxiliary ground may be arranged between the main ground and the PCB to form a return path for a signal received through the connection terminal.

The connection terminal may include multiple clock terminals, and the auxiliary ground may be arranged to be adjacent to the clock terminal.

If there are a plurality of main grounds, the auxiliary ground may be arranged to connect the plurality of main grounds.

The plurality of main grounds may be located to be separated from one another, and the auxiliary ground may be formed to connect one sides of the plurality of main grounds located to be separated from one another.

If there are a plurality of main grounds, the auxiliary ground may include a first auxiliary ground arranged to connect the plurality of main grounds; and a plurality of second auxiliary grounds arranged between the respective main grounds and the PCB to form a return path for a signal received through the connection terminals.

The multimedia interface connector may include a terminal holder for fixing the connection terminal at a particular position a predetermined distance away from the main ground.

The multimedia interface connector may include a High Definition Multimedia Interface (HDMI) connector.

BRIEF DESCRIPTION OF THE DRAWINGS

The above and/or other aspects will become more apparent by describing in detail exemplary embodiments with reference to the accompanying drawings, in which.

DETAILED DESCRIPTION OF EXEMPLARY EMBODIMENTS

Figure 1:
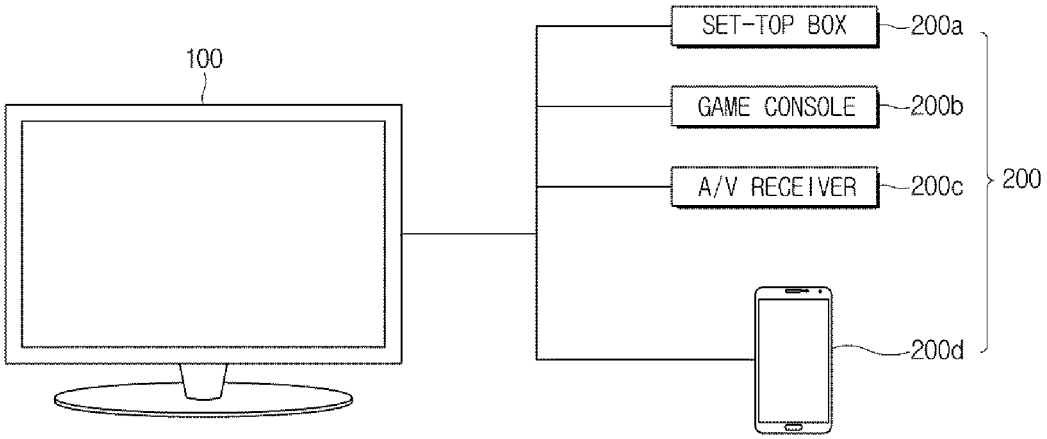
FIG. 1 shows connections between source and electronic devices.

The present disclosure will now be described more fully with reference to the accompanying drawings, in which exemplary embodiments of the disclosure are shown. The disclosure may, however, be embodied in many different forms and should not be construed as being limited to the exemplary embodiments set forth herein; rather, these exemplary embodiments are provided so that this disclosure will be thorough and complete, and will fully convey the concept of the disclosure to those skilled in the art Like reference numerals in the drawings denote like elements, and thus their description will be omitted. In the description, if it is determined that a detailed description of commonly-used technologies or structures related to the embodiments may unnecessarily obscure the subject matter of the exemplary embodiments, the detailed description will be omitted. It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section.

Exemplary embodiments will now be described with reference to accompanying drawings.

Figure 2:
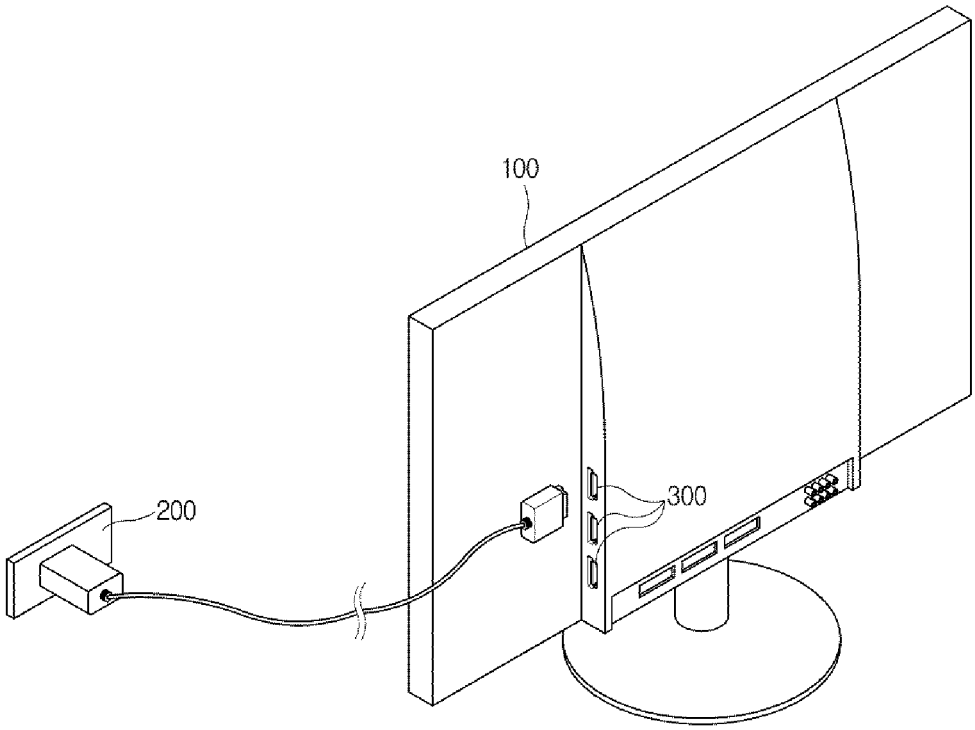
FIG. 2 shows a multimedia interface connector mounted on an electronic device.

FIG. 1 shows connections between source and electronic devices, and FIG. 2 shows a multimedia interface connector mounted on an electronic device.

Referring to FIG. 1, an electronic device 100 is a sink device connected to a source device 200 via a multimedia interface cable for receiving audio and video signals transmitted from the source device 200. The source device 200 may transmit audio and video signals in sync with a pixel clock.

The multimedia interface cable may be a High Definition Multimedia Interface (HDMI) cable.

For example, the source device 200 may be a set-top box 200*a*, a game console 200*b*, an Audio/Video (A/V) receiver 200*c*, and a mobile phone 200*d*, without being limited thereto, and may be any device connected to the electronic device 100 via an HDMI cable for transmitting signals. The A/V receiver 200*c* may include a video output end to be wiredly connected to a video input end (not shown) of the electronic device 100, and an audio output end to be wiredly connected to an audio input end (not shown) of the electronic device 100.

The electronic device 100 may be a digital television, without being limited thereto.

Referring to FIG. 2, the electronic device 100 and the source device 200 may include respective multimedia interface connectors 300, 210 to transmit or receive signals via an HDMI cable connected to the multimedia interface connectors 300, 210.

Figure 3:
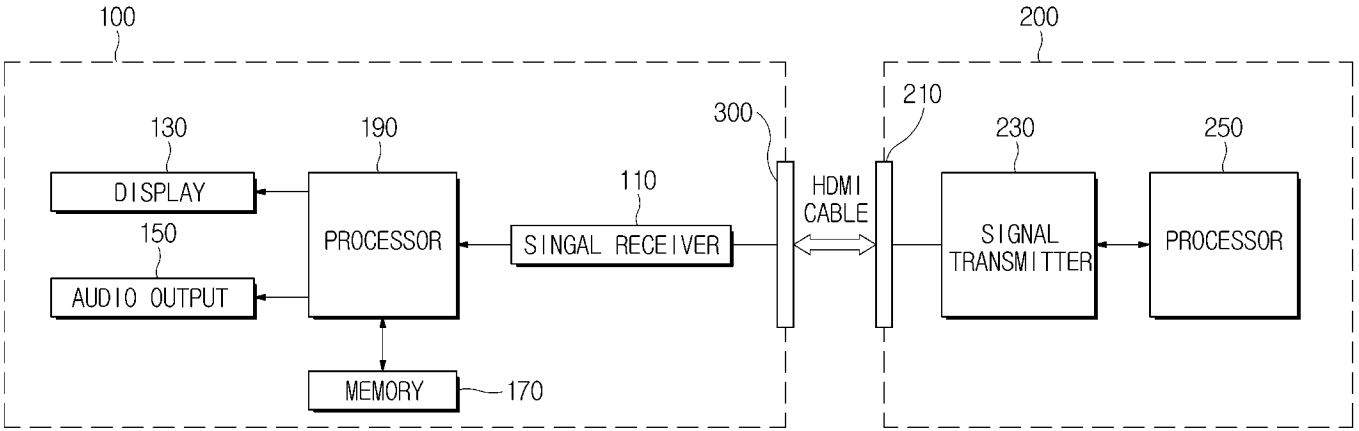
FIG. 3 is a control block diagram illustrating operation between an electronic device and a source device.

FIG. 3 is a control block diagram illustrating operation between an electronic device and a source device.

Referring to FIG. 3, the electronic device 100 may include a multimedia interface connector 300, a signal receiver 110, a display 130, an audio output 150, a memory 170, and a processor 190.

The multimedia interface connector 300 may be configured for a multimedia interface cable, e.g., the HDMI cable, to be connected between the electronic device 100 and the source device 200 for signal transmission or reception, and may be equipped in the electronic device 100. The multimedia interface connector 300 may be installed at any location in the electronic device 100 as long as the location allows easy connection with the source device 200.

The signal receiver 110 may receive video and/or audio signals transmitted from a signal transmitter 230 of the source device 200.

Although not shown, the signal receiver 110 may include a Transition Minimized Display Signaling (TMDS) decoder for performing TMDS decoding on HDMI signal converted into a format available for transmission from the multimedia interface.

The processor 190 may perform a video process function that processes a video signal received through the signal receiver 110 and outputs the result through the display 130, and an audio process function that processes an audio signal received through the signal receiver 110 and outputs the result through the audio output 150.

The memory 170 may be configured to store data related to the electronic device 100.

The memory 170 may also serve as an electrically erasable programmable read-only memory (EEPROM) for storing Extended Display Identification Data (EDID) data. The EDID data refers to a data format defined by the Video Electronics Standards Association (VESA), including information about a maker or a standard, basic display attributes, such as resolution and color format that may be supported, property information, and the like.

Referring to FIG. 3, the source device 200 may include a multimedia interface connector 210, a signal transmitter 230, and a processor 250.

The multimedia interface connector 210 may be configured for a multimedia interface cable, e.g., the HDMI cable, to be connected between the electronic device 100 and the source device 200 for signal transmission or reception, and may be equipped in the source device 200.

The signal transmitter 230 may transmit video and/or audio signals to the signal receiver 110 of the electronic device 100.

Specifically, the signal transmitter 230 may transmit the decoded video signal and/or audio signal in a format that fits the HDMI multimedia interface. Although not shown, the signal transmitter 230 may include a TMDS encoder (not shown) for performing TMDS encoding on the decoded data into a format available for transmission from the HDMI multimedia interface, and transmitting the encoding result to the electronic device 100 via the HDMI cable.

The processor 250 is configured to obtain EDID data in a data format to recognize the electronic device 100 through a display data channel (DDC) line (not shown) while being connected to the HDMI cable. For example, the processor 250 may check a communication state of the DDC line and a signal state of a hot plug to detect whether the HDMI cable is connected to the electronic device 100, and if it is determined that the HDMI cable is connected to the electronic device 100, control the output port to be automatically set to HDMI.

In the following, a multimedia interface connector equipped in the electronic device 100 will be described as an example.

Figure 4:
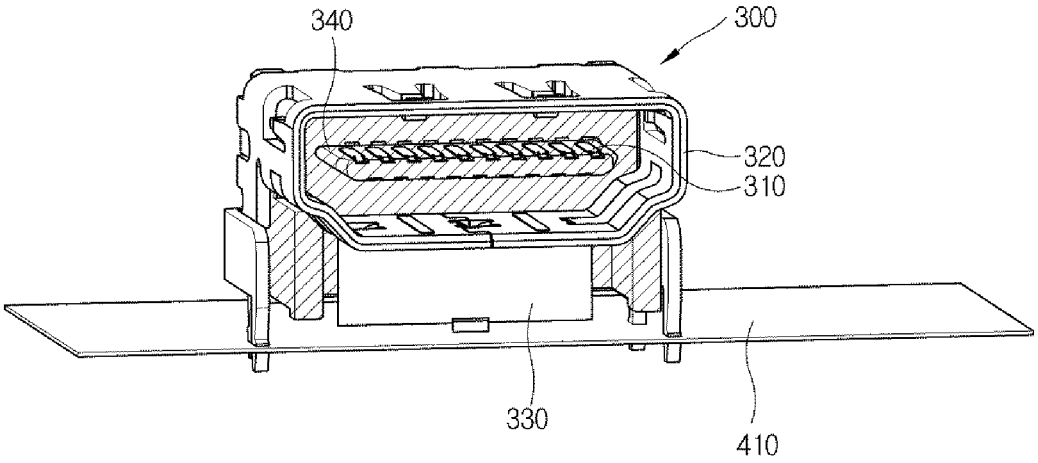
FIGS. 4 and 5 show a multimedia interface connector, according to an exemplary embodiment.
Figure 5:
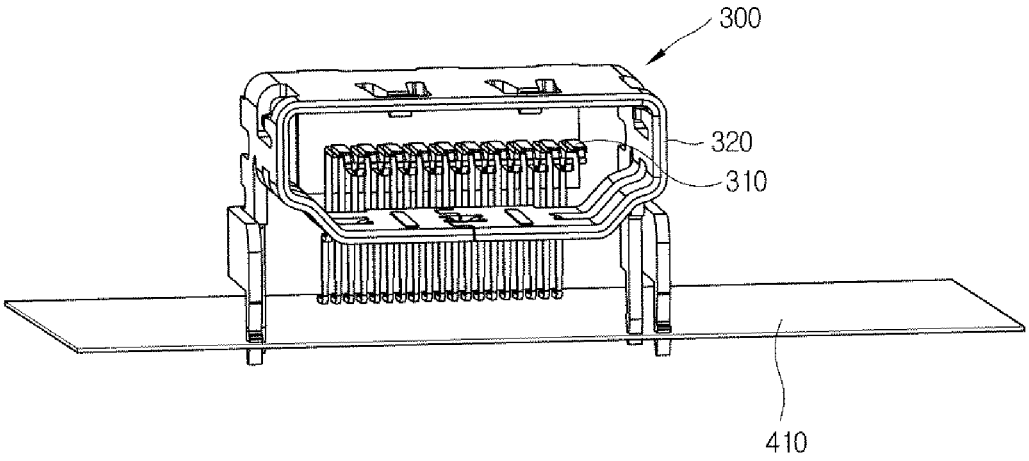

FIGS. 4 and 5 show a multimedia interface connector, according to an exemplary embodiment.

A multimedia interface connector will now be described in connection with FIG. 6 that shows transmission and return paths between an electronic device and a source device, FIG. 7 that shows arrangement of an electronic device having the multimedia interface connector applied thereto, FIGS. 8 and 9 that show diagrams for explaining signal transmission and return paths in the multimedia interface connector, and FIGS. 10 and 11 that show diagrams for explaining examples of field distribution analysis in cases that respective multimedia interface connectors are applied to the electronic device, according to an exemplary embodiment.

Referring to FIG. 4, a multimedia interface connector 300 may include connection terminals 310, a main ground, an auxiliary ground 330, and a terminal holder 340.

The connection terminals 310 may be combined with a Printed Circuit Board (PCB).

Referring to FIG. 5, one end of the connection terminals 310 is exposed to be connected to a connector of an HDMI cable, while the other end is combined with a PCB 410 to deliver signals transmitted from the source device 200. The terminal holder 340 is omitted in FIG. 5 for convenience of explanation.

The connection terminals 310 are made of a conducting material to receive audio and video signals transmitted from the source device 200 via the HDMI cable.

The connection terminals 310 include multiple clock terminals.

Specifically, the connection terminals 310 has 19 pins, including a differential pair of one clock (CLK) lane and three data lanes, DDC I2C, Hot Plug Detect (HPD) lines, etc.

The main ground 320 has a form to cover one side of the connection terminals 310 while leaving them opened in a first direction. In this regard, as shown in FIG. 4, the main ground 320 may be formed to cover the one side of the connection terminals 310 at a distance.

As shown in FIG. 4, the main ground 320 may be combined with the PCB 410.

The auxiliary ground 330 is arranged between the main ground 320 and the PCB 410 to form a return path for a signal received through the connection terminals 310.

The auxiliary ground 330 may be arranged to be adjacent to the clock terminal.

Among the lines connected to the electronic device 100, in particular, the clock terminal (CLK) causes electromagnetic interference (EMI), and it is thus expected that the auxiliary ground 330 arranged to be adjacent to the clock terminal may reduce the EMI produced from the clock terminal.

Figure 6:
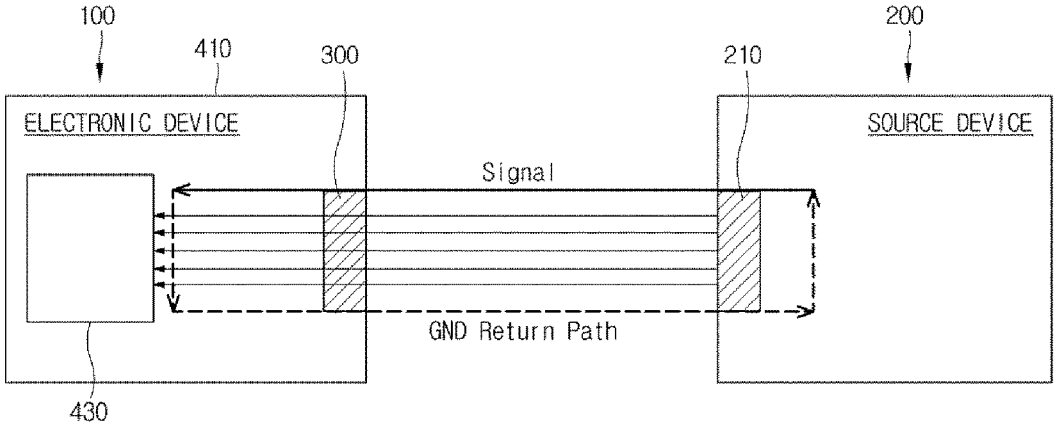
FIG. 6 shows transmission and return paths between an electronic device and a source device.
Figure 7:
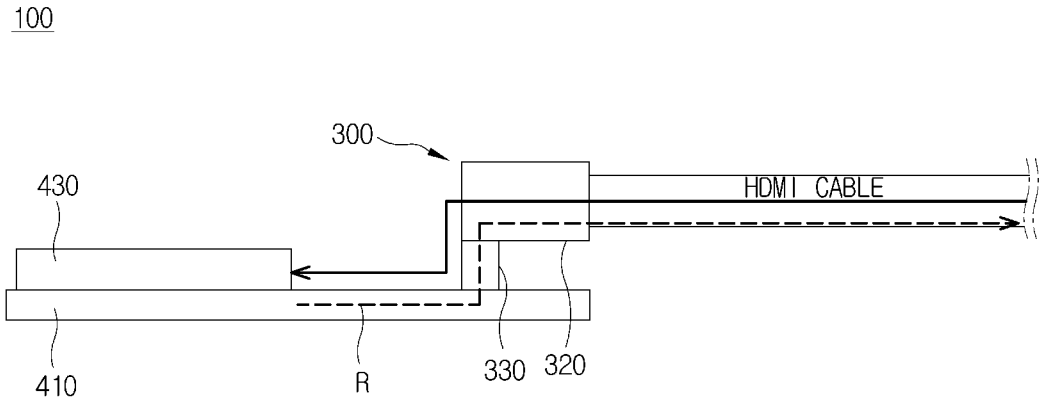
FIG. 7 shows an electronic device having a multimedia interface connector applied thereto.

Referring to FIGS. 6 and 7, the electronic device 100 may be connected to the source device 200 via the HDMI cable for receiving video and audio signals, and may form a return path R of FIG. 7 with the main ground 320 and the auxiliary ground 330.

Figure 8:
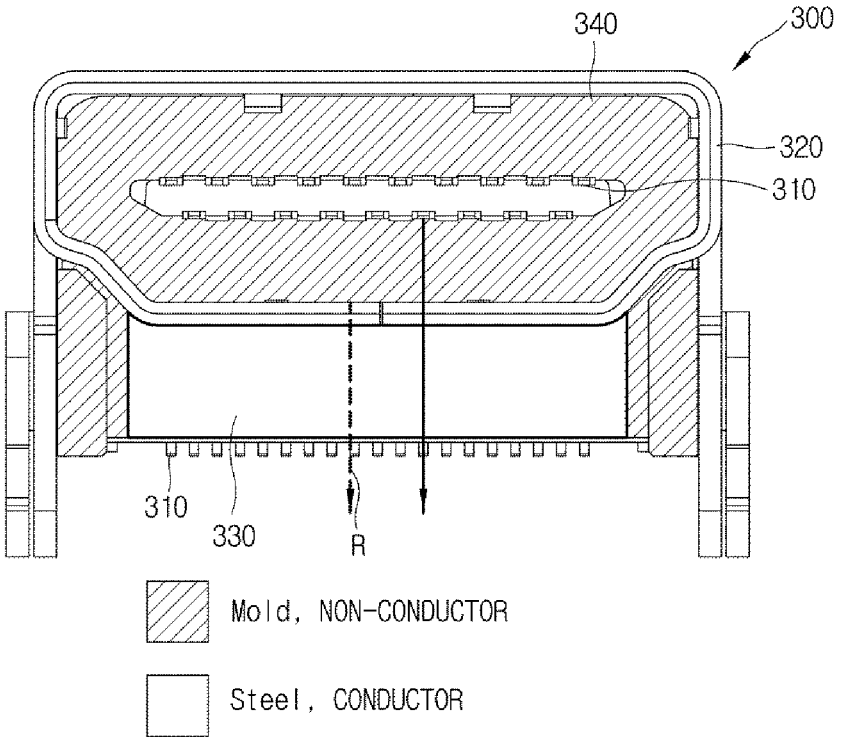
FIGS. 8 and 9 are diagrams for explaining signal transmission and return paths in a multimedia interface connector.
Figure 9:
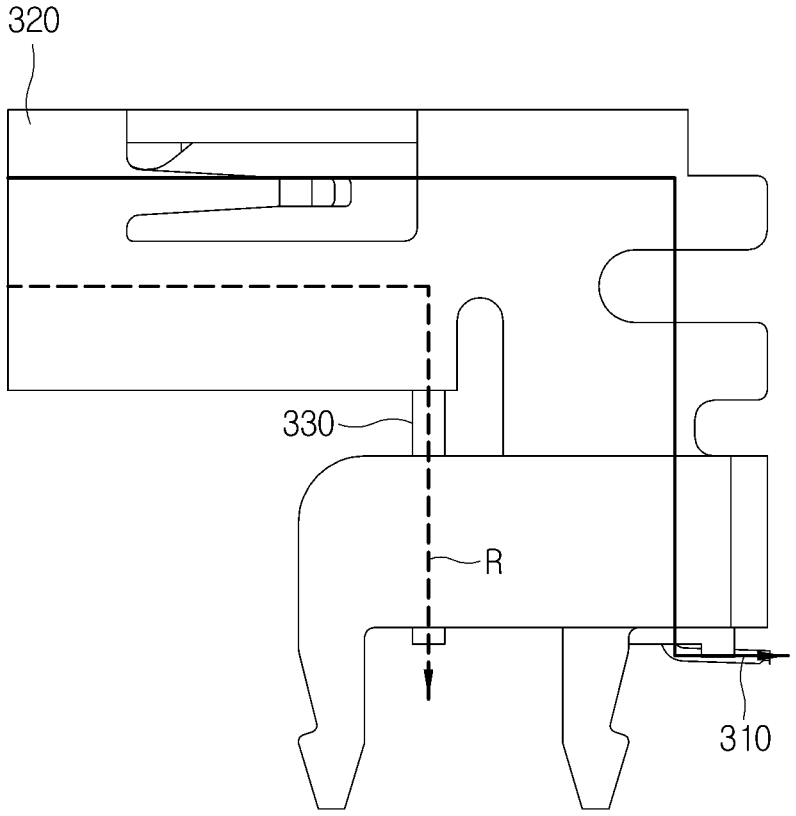

Referring to FIGS. 8 and 9, since the auxiliary ground 330 arranged between the main ground 320 and the PCB 410 of FIG. 7 forms a return path of the multimedia interface clock line, it may change resonance characteristics of the radiated noise produced by the connection terminals 310, particularly, the clock terminal. The terminal holder 340 is omitted in FIG. 9 for convenience of explanation.

Specifically, in a case that only the main ground 320 is equipped in the multimedia interface connector 300, a longer return path may be formed than in the case that the auxiliary ground 330 is also arranged.

The present disclosure is about a structure in which the auxiliary ground 330 connects the main ground 320 and the PCB 410. With this structure, an effect of reducing EMI may be expected by shortening the return path by arranging the auxiliary ground 330 in addition to the main ground 320 rather than arranging only the main ground 320.

As shown in FIG. 4, the terminal holder 340 may be arranged to fix the connection terminals 310 at a certain position a predetermined distance away from the main ground 320. The terminal holder 340 may be made of an insulating material.

As shown in FIG. 4, the terminal holder 340 may be formed to cover the connection terminals 310 while leaving one side of the connection terminals 310 connected to the HDMI cable connector and the other side of the connection terminals that comes in contact with the PCB 410 exposed.

Figure 10:
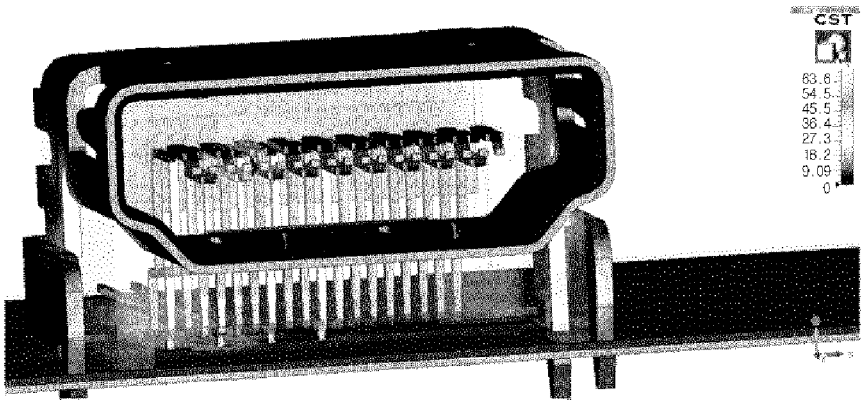
FIGS. 10 and 11 are illustrations for explaining examples of field distribution analysis in cases that respective multimedia interface connectors are applied to an electronic device, according to an exemplary embodiment.
Figure 10:
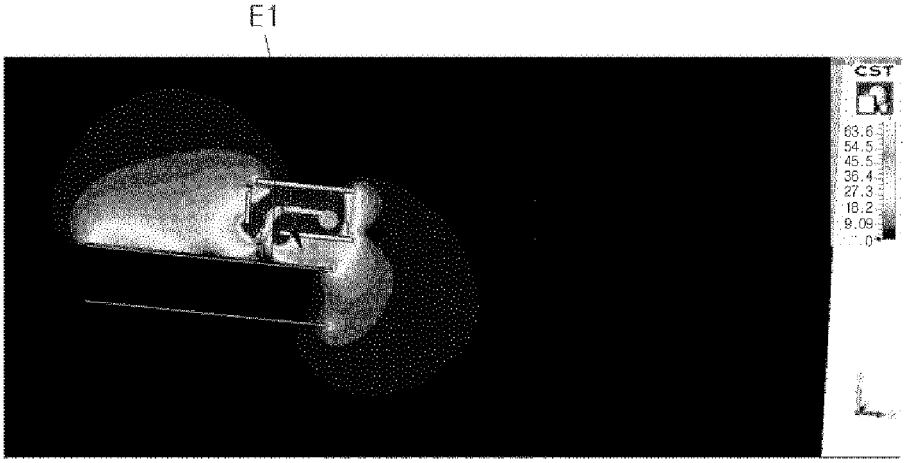
Figure 11:
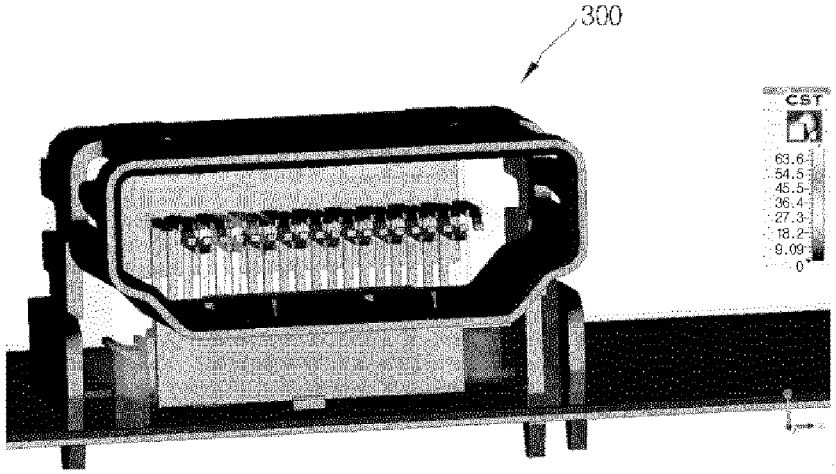
Figure 11:
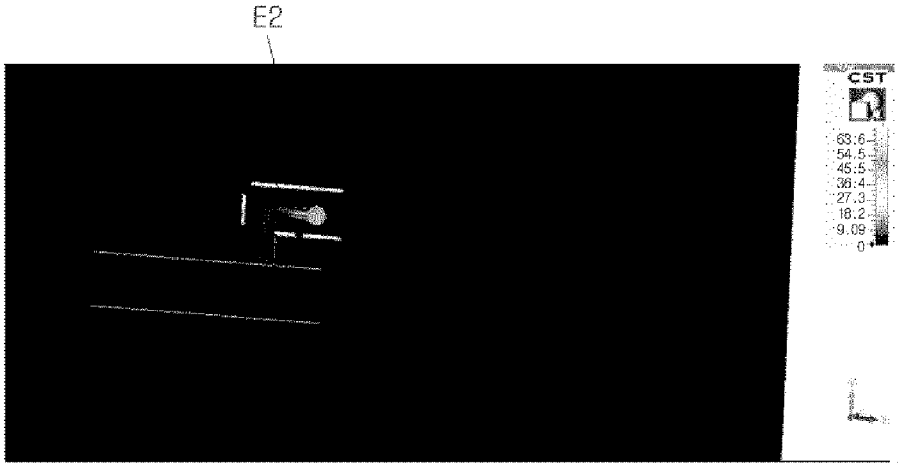

FIGS. 10 and 11 show examples of field distribution analysis (about e.g., surface current and radiation pattern at a frequency of 2.6 GHz) in cases that a general multimedia interface connector ((a) of FIG. 10)) and the multimedia interface connector 300 of FIG. 4 ((a) of FIG. 11)) are applied to the electronic device. Referring to area E1 in (b) of FIG. 10 and area E2 in (b) of FIG. 11, it is seen that EMI characteristics do not appear when the multimedia interface connector of FIG. 4 is applied as compared to when the general multimedia interface connector is applied. (b) of FIG. 10 and (b) of FIG. 11 show EMI characteristics in the area where the multimedia interface connectors are mounted.

Figure 12:
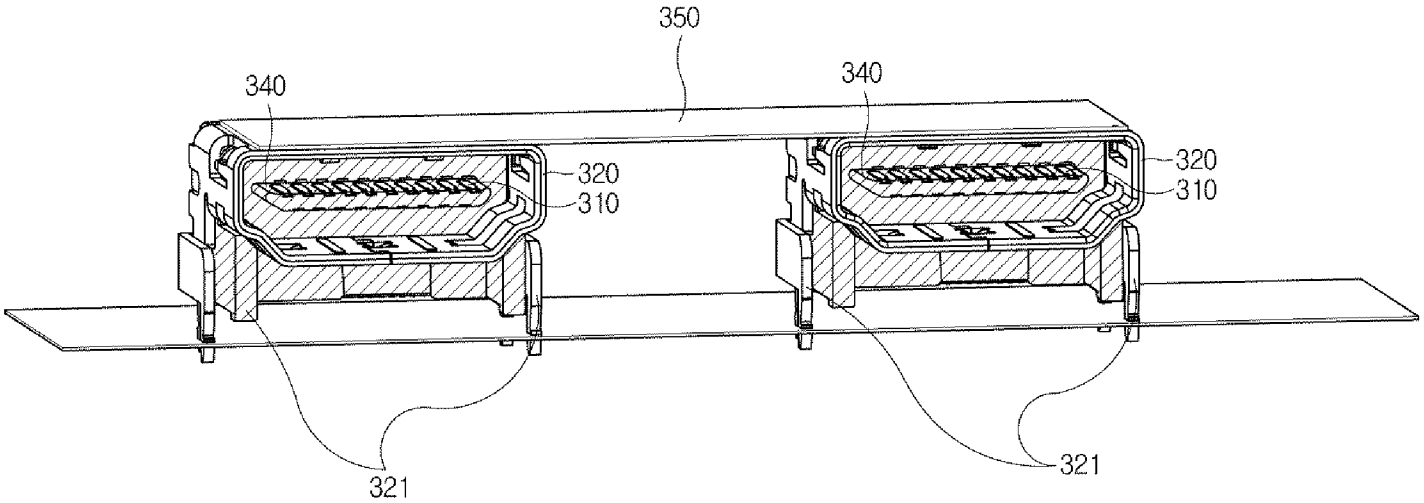
FIG. 12 shows a multimedia interface connector, according to an exemplary embodiment.

FIG. 12 shows a multimedia interface connector, according to an exemplary embodiment.

In the following, the same description as described in connection with FIGS. 1 to 9 will be omitted.

The multimedia interface connector 300 may include multiple groups of connection terminals 310 combined with the PCB 410, a plurality of main grounds 320 formed to cover one side of the respective groups of connection terminals while leaving them opened in a first direction, an auxiliary ground 350 arranged to connect the plurality of main grounds 320, and a terminal holder 340 for fixing the connection terminals 310 at a certain position a predetermined distance away from the main grounds 320. The main grounds 320 may be combined with the PCB 410. As shown in FIG. 12, the main grounds 320 include supporters 321 that extend downward to be combined with the PCB 410.

The plurality of main grounds 320 are placed to be separated from one another, as shown in FIG. 12. The auxiliary ground 350 may be formed to connect one sides of the plurality of main grounds 320 located to be separated from one another.

Because of the auxiliary ground 350 additionally arranged to connect the plurality of main grounds to one another, an effect may be expected to cancel a resonance frequency radiated as the number of supporters 321 even increases.

While the auxiliary ground 350 connects 2 main grounds 320 in FIG. 12, it is not limited thereto but more main grounds 320 may be connected via the auxiliary ground 350 as needed by the user.

The respective main grounds 320 may be formed to cover the one side of the connection terminals 310 at a distance.

There may be a number of terminal holders 340 to correspond to the plurality of main grounds 320. The terminal holder 340 may be made of an insulating material.

Figure 13:
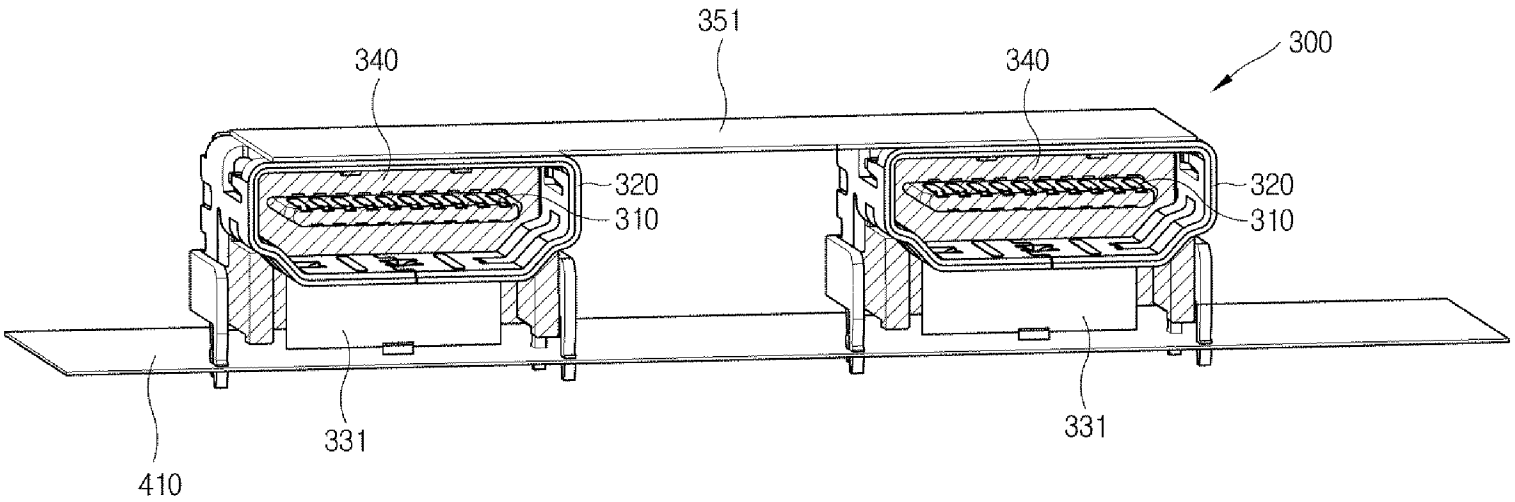
FIG. 13 shows a multimedia interface connector, according to an exemplary embodiment.

FIG. 13 shows a multimedia interface connector, according to an exemplary embodiment.

The multimedia interface connector 300 may include multiple groups of connection terminals 310 combined with the PCB 410, a plurality of main grounds 320 formed to cover one sides of the multiple groups of connection terminals while leaving them opened in a first direction, a first auxiliary ground 351 arranged to connect the plurality of main grounds 320, a plurality of second auxiliary grounds 331 arranged between the respective main grounds 320 and the PCB 410 to form a return path of a signal received through the connection terminals 310, and a terminal holder 340 for fixing the connection terminals 310 at a certain position a predetermined distance away from the main grounds 320. The main grounds 320 may be combined with the PCB 410.

The plurality of main grounds 320 are placed to be separated from one another, as shown in FIG. 13. The first auxiliary ground 351 may be formed to connect one sides of the plurality of main grounds 320 located to be separated from one another.

Results of measuring radiated EMI data of the multimedia interface connector 300 may be the same as what is listed in the following table 1.

Figure 14:
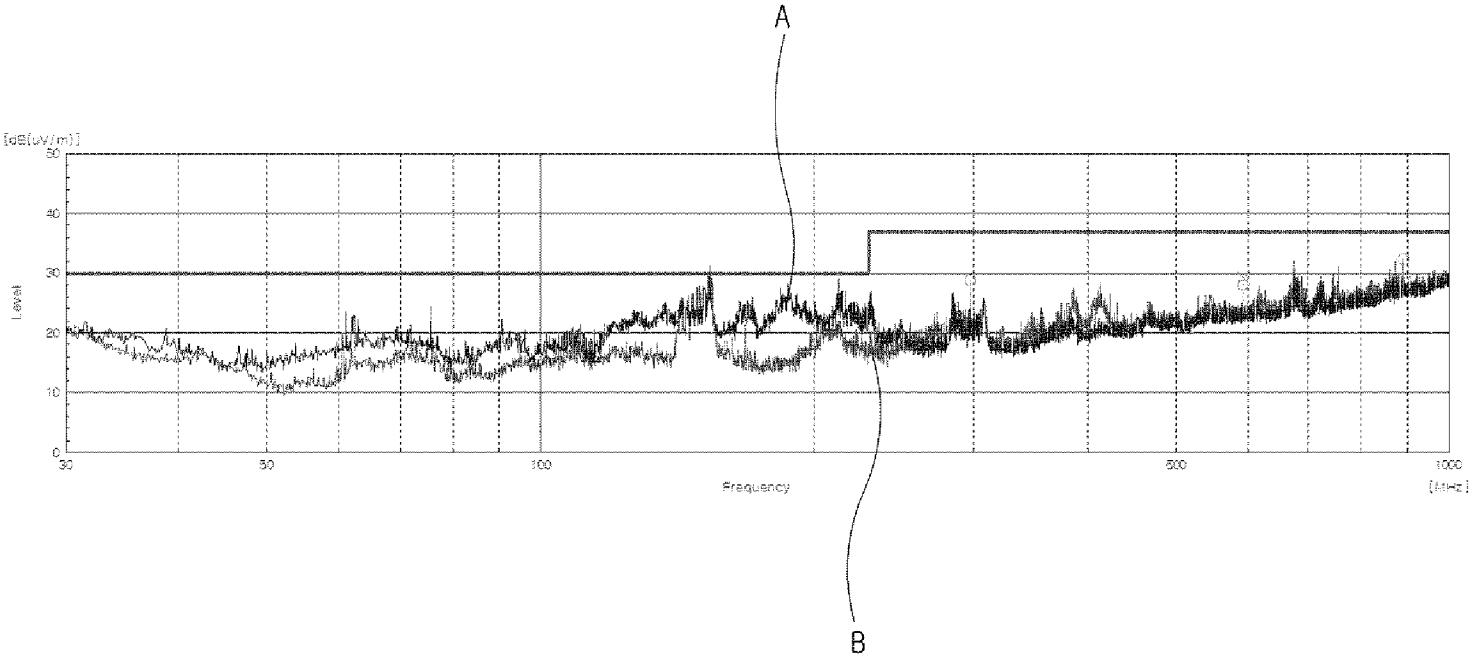
FIG. 14 shows results of measuring radiated electromagnetic interface (EMI) data of a multimedia interface connector.

Referring to FIG. 14 and table 1, as the first auxiliary ground 351 and the second auxiliary grounds 331 are applied to the multimedia interface connector 300, resonance characteristics do not appear at the respective frequencies of table 1, not exceeding a reference value of 37 [dBuV/m] and securing the margin from 4.8 [dBuV/m] to 8.9 [dBuV/m] compared to the reference value, which meets the EMI criteria.

In FIG. 14, 'A' indicates 'horizontal', and 'B' indicates 'vertical'.

TABLE 1

| Frequency [MHz] | (P) | Reading [dBuV/m] | Factor [dBuV/m] | Level PK [dBuV/m] | Limit QP [dBuV/m] | Margin QP [dBuV/m] | Height [cm] | Angle [degree] |
|---|---|---|---|---|---|---|---|---|
| 891.117 | H | 36 | −3.8 | 32.2 | 37 | 4.8 | 400 | 257.9 |
| 296.993 | H | 43.4 | −14.5 | 28.9 | 37 | 8.1 | 300 | 340.3 |
| 594.055 | H | 35.6 | −7.5 | 28.1 | 37 | 8.9 | 100 | 130.1 |
| 594.055 | V | 25.9 | −6.7 | 29.2 | 37 | 7.8 | 200 | 149.3 |

In the following, a case where the multimedia interface connector 300 is equipped in the electronic device 100 will be described by taking an example of what is described above in connection with FIGS. 4, 7, 9, 12 and 13.

The same description as described in connection with FIGS. 1 to 13 will be omitted.

Referring to FIG. 7, the electronic device 100 may include a semiconductor device 430, a PCB 410 having the semiconductor device 430 mounted thereon, and a multimedia interface connector 300 combined with a source device e.g., 200 of FIG. 6, for receiving multimedia signals (e.g., video and audio signals) transmitted from the source device 200.

The multimedia interface connector 300 may include connection terminals 310 combined with the PCB 410, a main ground 320 formed to cover one side of the connection terminals while leaving them opened in a first direction, an auxiliary ground 330 combined with the main grounds 320, and a terminal holder 340 for fixing the connection terminals 310 at a certain position a predetermined distance away from the main ground 320. The multimedia interface connector 300 may be a High Definition Multimedia Interface (HDMI) connector.

First, turning back to FIG. 4, the auxiliary ground 330 is arranged between the main ground 320 and the PCB 410 to form a return path for a signal received through the connection terminals 310. The connection terminals may include a plurality of clock terminals. The auxiliary ground 330 may be placed to be adjacent to the clock terminals.

Second, referring to FIG. 12, if there are multiple main grounds 320, the auxiliary ground 350 may be formed to connect the multiple main grounds 320.

The multiple main grounds 320 are placed to be separated from one another, as shown in FIG. 12, and the auxiliary ground 350 may be formed to connect one sides of the plurality of main grounds 320 located to be separated from one another.

Third, referring to FIG. 13, if there are multiple main grounds 320, the auxiliary ground 350 may include a first auxiliary ground 351, and a plurality of second auxiliary grounds 331 arranged between the respective main grounds 320 and the PCB 410 to form a return path of a signal received through the connection terminals 310.

In the embodiments, the return path and ground for the multimedia interface clock is reinforced, thereby suppressing resonance characteristics at a multiplied frequency of 297 MHz.

According to exemplary embodiments, an auxiliary ground additionally arranged adjacent to a clock terminal may reduce a ground return path and thus reduce EMI radiated around the clock line.

Furthermore, an auxiliary ground additionally arranged to connect a plurality of main grounds with each other enables use of the plurality of main grounds, thereby reducing EMI.

Several embodiments have been described, but a person of ordinary skill in the art will understand and appreciate that various modifications can be made without departing the scope of the present disclosure. Thus, it will be apparent to those ordinary skilled in the art that the disclosure is not limited to the embodiments described, which have been provided only for illustrative purposes.

What is claimed is:

1. A multimedia interface connector comprising:

a connection terminal in electrical connection with a printed circuit board (PCB);

a main ground partially enclosing a first end of the connection terminal and including a support extending downward to be combined with the PCB; and an auxiliary ground connected to the main ground, wherein a second end of the connection terminal and the main ground are connected to the PCB, wherein when the main ground comprises a plurality of main grounds, the auxiliary ground comprises:

a first auxiliary ground provided on a side of the plurality of main grounds opposite to the PCB and arranged to connect the plurality of main grounds; and a plurality of second auxiliary grounds arranged between a respective main ground of the plurality of main grounds and the PCB, each second auxiliary ground being formed in a plate shape of a vertical wall in a space defined by the support between the respective main ground of the plurality of main grounds and the PCB, to form a return path for a signal received through the connection terminal.

2. The multimedia interface connector of claim 1, wherein the connection terminal comprises a plurality of clock terminals, and wherein the plurality of second auxiliary grounds are arranged to be adjacent to the plurality of clock terminals.

3. The multimedia interface connector of claim 1, wherein the main ground and the connection terminal are spaced apart by a distance.

4. The multimedia interface connector of claim 1, further comprising a terminal holder that fixes the connection terminal at a predetermined distance away from the main ground.

5. The multimedia interface connector of claim 4, wherein the terminal holder comprises an insulating material.

6. The multimedia interface connector of claim 1, wherein the plurality of main grounds are located to be separated from one another.

7. The multimedia interface connector of claim 1, wherein a quantity of the plurality of terminal holders corresponds to a quantity of the plurality of main grounds.

8. An electronic device comprising:

a semiconductor device;

a printed circuit board (PCB) having the semiconductor device mounted thereon; and a multimedia interface connector coupled with a source device for receiving a multimedia execution signal transmitted from the source device, wherein the multimedia interface connector comprises:

a connection terminal in electrical connection with the PCB;

at least one main ground partially enclosing a first end of the connection terminal and including a support extending downward to be combined with the PCB; and an auxiliary ground connected to the main ground, wherein when the main ground comprises a plurality of main grounds, the auxiliary ground comprises:

a first auxiliary ground provided on a side of the plurality of main grounds opposite to the PCB and arranged to connect the plurality of main grounds; and a plurality of second auxiliary grounds arranged between a respective main ground of the plurality of main grounds and the PCB, each second auxiliary ground being formed in a plate shape of a vertical wall in a space defined by the support between the respective main ground of the plurality of main grounds and the PCB, to form a return path for a signal received through the connection terminal.

9. The electronic device of claim 8, wherein the connection terminal comprises a plurality of clock terminals, and wherein the plurality of second auxiliary grounds are arranged to be adjacent to the plurality of clock terminals.

10. The electronic device of claim 8, wherein the plurality of main grounds are located to be separated from one another.

11. The electronic device of claim 8, wherein the multimedia interface connector further comprises a terminal holder that fixes the connection terminal at a predetermined distance away from the main ground.

12. The electronic device of claim 8, wherein the multimedia interface connector further comprises a High Definition Multimedia Interface (HDMI) connector.

* * * * *